US005568820A

United States Patent [19]

Dirksing

[11] Patent Number: 5,568,820

[45] Date of Patent: Oct. 29, 1996

[54] COMPACT CASE HAVING A 360 DEGREES ROTATABLE COVER

[75] Inventor: Robert S. Dirksing, Cincinnati, Ohio

[73] Assignee: The Procter & Gamble Company, Cincinnati, Ohio

[21] Appl. No.: 547,858

[22] Filed: Oct. 25, 1995

[51] Int. Cl.[6] ..... A45D 27/22; B65D 43/14

[52] U.S. Cl. ..... 132/315; 132/293; 132/295; 206/581; 220/339

[58] Field of Search ..... 132/293, 295, 132/315, 316, 314, 312; 206/235, 581, 587, 37, 38, 261, 263, 268; 220/337, 338, 341, 342, 343, 339

[56] References Cited

U.S. PATENT DOCUMENTS

| | | | |
|---|---|---|---|
| 4,195,650 | 4/1980 | Ullmann et al. | 132/315 |
| 4,363,403 | 12/1982 | Raucci, Jr. et al. | 206/387 |
| 4,684,017 | 8/1987 | Watanabe et al. | 206/235 |
| 4,840,288 | 6/1989 | Lunderman et al. | 220/334 |
| 5,078,159 | 1/1992 | Yuhara | 206/581 |
| 5,360,114 | 11/1994 | Weidt | 206/506 |

*Primary Examiner*—Gene Mancene
*Assistant Examiner*—Pedro Philogene
*Attorney, Agent, or Firm*—Ronald W. Kock

[57] ABSTRACT

A compact case comprises a base and a cover portion. The cover portion includes a cover integrally joined to a hinge link by a flexible hinge strap. The compact case further comprises a hinge pin for rotatably attaching the hinge link of the cover portion to the base. The compact case has an initial show shade condition wherein an upper surface of the cover abuts a lower surface of the base. The cover may later be rotated 360° about the hinge pin and the hinge strap to a closed condition. The cover may also have a latch adapted to engage a tab on the hinge link to irreversibly connect the tab to the latch.

3 Claims, 5 Drawing Sheets

COMPACT CASE HAVING A 360 DEGREES ROTATABLE COVER

FIELD OF THE INVENTION

The present invention relates to a compact case, and more particularly to a compact case having a cover which is initially stowable in a position beneath the base of the compact such that a cosmetic product contained in the base may be exposed for display. Even more particularly, the present invention relates to the hinge arrangement for enabling the compact case cover to be rotated 360° to beneath the compact base.

BACKGROUND OF THE INVENTION

Compact cases for cosmetic products, such as pressed powders, typically comprise a cover pivotally connected to a base by a hinge. For access to the cosmetic product, the hinge should permit rotation of the cover from a closed position to an open position of between 90° and 130°. To permit unobstructed access to the contents or to permit viewing of a mirror which is often installed in the cover, many compact cases permit further opening of the compact cover to about 180° from the closed position.

In purchasing a cosmetic compact, the primary selling feature to the consumer is the color shade of the pressed powder. Consumers prefer to see the actual color shade of the pressed powder, not simply a representation of the color, such as a printed color swatch. The term describing the presentation of the actual pressed powder color is "show shade". Showing color shade presents a problem of how to show shade while protecting the pressed powder. One solution is to provide a clear cover; however, in compact cases which have a mirror installed in the cover, this is not practical.

Another method to provide show shade is to rotate the cover 180° from the closed position so that the cover lies nearly in the same plane as the base. The fully opened compact may then be displayed while protected within a clear blister package. The open display has the advantage of permitting the potential consumer to view the color of the pressed powder. It has the disadvantage of consuming at least twice the valuable display space of a closed compact. Considering the rather vast array of cosmetic products, compounded by the spectrum of colors for each, displaying cosmetic compacts opened is discouraged by most merchandisers. The competition for display space is already intense.

An alternative solution is to package the compact with the cover rotated 360° from the closed position so that the upper surface to the cover faces the lower surface of the base. In this condition, the open compact occupies the same display area footprint as the closed compact. Assuming a clear packing material such as a shrink film or blister, the color of the cosmetic product may still be viewed by a potential consumer. However, standard cosmetic case hinge designs don't permit cover rotation of 360°. Multi-link hinges have been proposed to provide 360° rotation of the cover about the base to provide a smaller size show shade package, but this method requires additional parts, assembly operations, has poorer appearance, and adds expense.

For example, U.S. Pat. No. 4,684,017 issued to Watanabe et al. on Aug. 4, 1987, discloses a compact ease including a base and cover connected to each other by a hinge piece rotatably connected to the cover and base by means of first and second shaft, respectively. Since the connection between the cover and the hinge piece permits about 180° of rotation and since the connection between the hinge piece and the base further permits an additional 180°, the cover is thus able to rotate 360° from the closed position. With the cover fully rotated, the upper surface to the cover faces the lower surface of the base. In this condition, the pressed powder contents are presented. Watanabe et al. further discloses an anchoring means which serves to secure the hinge piece to the base upon full closure of the cover to the base. The anchoring means disclosed is a projection on the base which engages a groove in the hinge piece. The anchoring means prevents subsequent rotation of the hinge piece relative to the base when the cover is released from the fully closed position. In normal use the cover rotates relative to the base only about the first shaft with the hinge piece not involved in the rotation. However, the anchoring means disclosed is a friction attachment and may be disengaged if the user desires to rotate the cover a full 360° from the closed position.

U.S. Pat. No. 4,840,288, issued to Lunderman et al. on Jun. 20, 1989, discloses a cosmetic compact ease similar in operation and intent to that disclosed in U.S. Pat. No. 4,684,017, except that Lunderman et al. further discloses a non-releasable locking means for securing the hinge piece to the base. The non-releasable locking means disclosed includes a latching projection that irreversibly attaches the hinge piece to the base versus the releasable friction anchoring means disclosed by Watanabe et al.

U.S. Pat. No. 5,078,159, issued to Yuhara on Jan. 7, 1992, discloses a cosmetic compact ease very similar in operation and intent as that disclosed in U.S. Pat. No. 4,840,288 except that Yuhara includes notches in the rear of the cover which serve to hide the hinge link when viewed from above.

In each of the above cited patents, the a separate link is disclosed to provide the compound rotation. Further, the curtailment of one component of the compound rotation is accomplished by attaching the link non-rotatably to the base, although, as disclosed by Watanabe, such attachment may be reversible.

U.S. Pat. No. 4,363,403, issued to Raueci, Jr. et al. on Dec. 14, 1982, discloses a cassette storage container injection molded in a unitary structure of a thermoplastic material. The container includes wall structures rotatably connected to one another by a hinge of polymeric material, such as polypropylene, to provide what are commonly known as "living hinges". The hinge is integrally molded to the wall structures. Hinges of ibis sort eliminate the complexity of hinge pins and their associated unit and assembly cost.

This development provides a compound hinge that is integrally molded preferably to the compact cover but may alternatively be integrally molded onto the base. It permits folding the cover 360° such that the top of the cover opposes the bottom of the base without a separate articulating link.

Since the show shade feature has no purpose beyond displaying the color for merchandising, the compact of this development converts into a conventional compact. That is, rotation of the compact cover from a closed position is limited to less than 180°.

SUMMARY OF THE INVENTION

In one aspect of the present invention a compact case comprises a base having a base notch and a lower surface. It also comprises a cover portion including a cover integrally joined to a hinge link by a flexible hinge strap. The cover also has a cover notch and an upper surface. The compact case further comprises a hinge pin for rotatably attaching the hinge link of the cover portion in the base notch of the base. The compact case has an initial show shade condition wherein the upper surface of the cover abuts the lower surface of the base. The cover may later be rotated 360° about the hinge pin and the hinge strap to a closed condition.

The cover may also have at least one latch adapted to engage at least one tab on the hinge link to irreversibly connect the at least one tab to the at least one latch. In addition, the hinge strap is between 0.010 and 0.015" thick to enable it to flex for the life of the compact case.

The present invention reduces the number of parts required to provide rotation of the cover to a show shade display condition. It further simplifies the assembly and reduces cost. In addition, the present .invention also incorporates the hinge and latching system integrally into the cover portion. Accordingly, accuracy of the fit between the cover, hinge link and latching system is fixed within the molding process of the cover portion. Furthermore, the elimination of a second hinge pin improves the appearance of the compact case. Further still, as the hinge link is integrally connected and latched to the cover, the axis of rotation of the cover portion is offset downward from the plane of the cover. This provides a further advantage in that the cover portion rotates about the hinge pin in the base, which shifts the cover portion outward to the rear of the compact base, thereby providing improved access to the base contents and cover mirror.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE INVENTION

Figure 1:
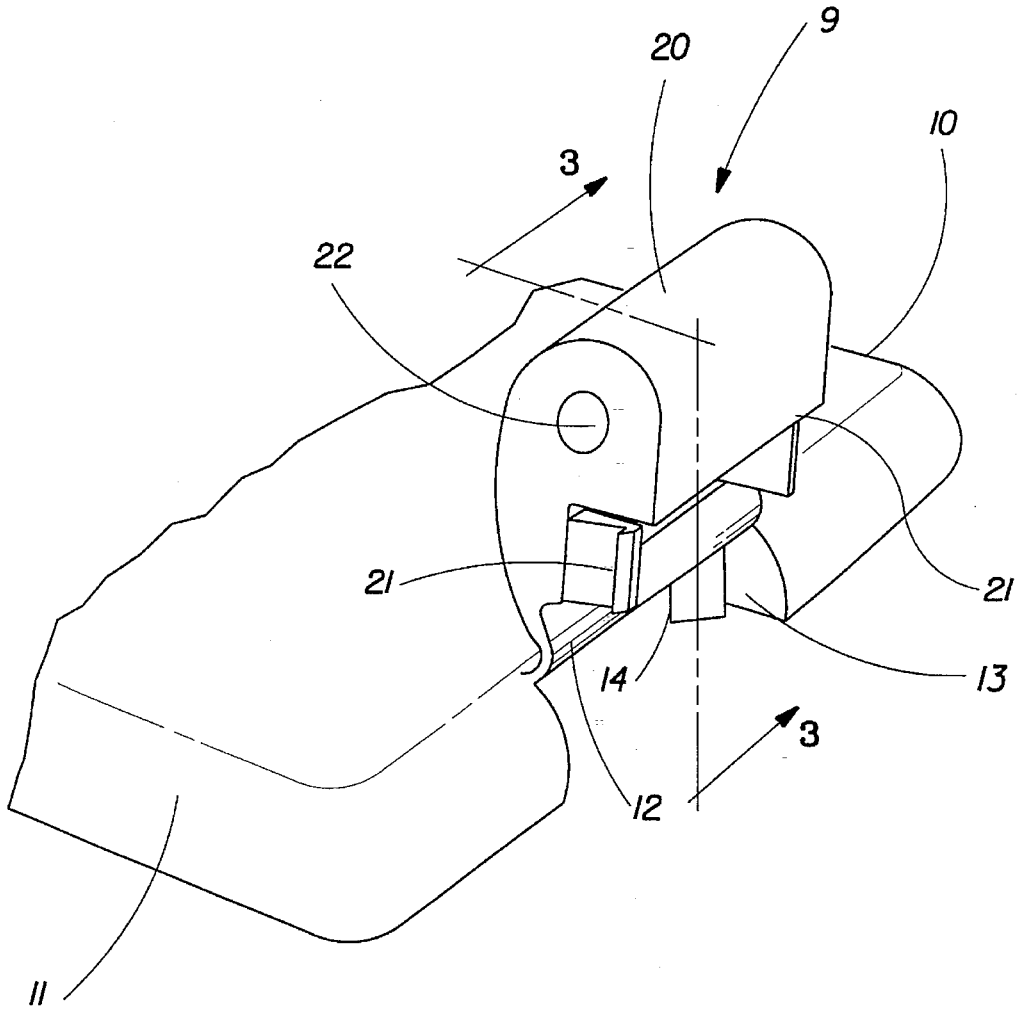
FIG. 1 is a partial perspective view of a cover portion of a cosmetic compact case, made in accordance with the present invention, shown disassembled from the base.

Referring now to the drawings, and more particularly to FIGS. I and 2, there is shown a preferred embodiment of the cosmetic compact case of the present invention, which is generally indicated as 9. Cosmetic compact case has cover portion 10 and base 30.

In FIG. 1 there is shown a portion of cover portion 10 for cosmetic compact case 9 comprising a cover 11 integrally connected to a hinge link 20 by a hinge strap 12. Cover 11 has a cover notch 13 at its rear end and a pair of tabs 14 at the interior of cover notch 13. Hinge link 20 has a pair of barbed latches 21 and a hole 22. Hinge strap 12 is a thin flexible member that permits rotation of hinge link 20 relative to cover 11. The thickness of hinge strap 12 is typically 0.010" to 0.015". Cover notch 13 provides clearance for hinge link 20 when hinge link 20 is rotated about hinge strap 12.

Figure 2:
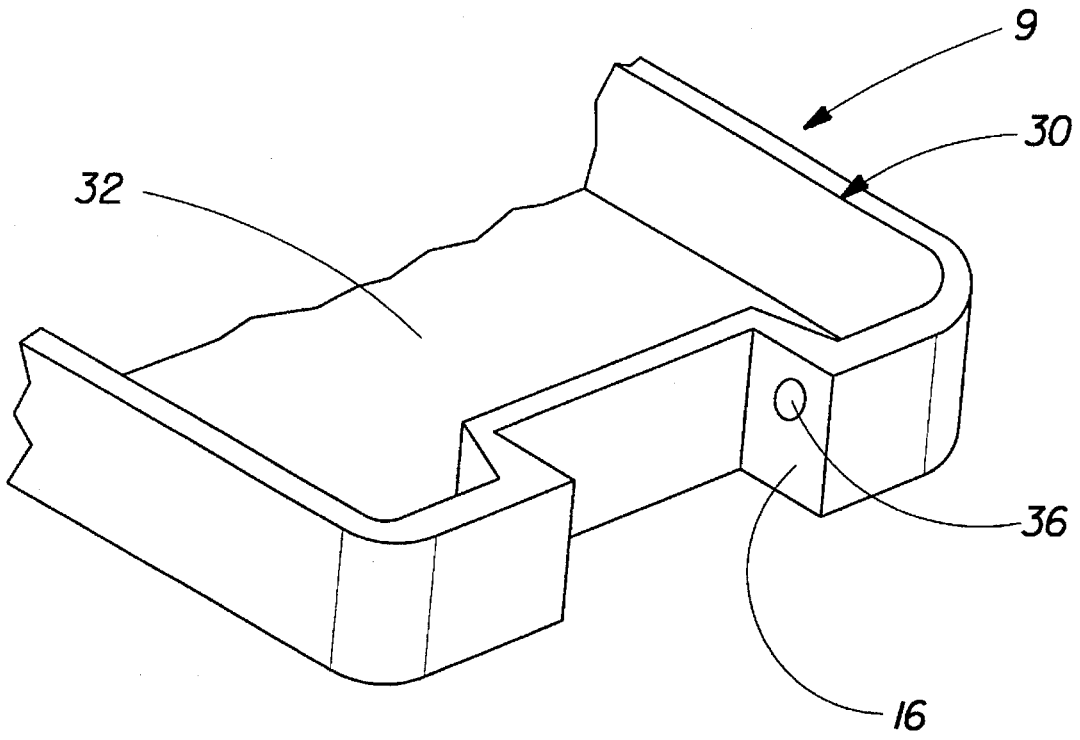
FIG. 2 is a partial perspective view of a base of a compact case, made in accordance with the present invention, shown disassembled from the cover portion.

In FIG. 2 there is shown a portion of base 30. Base 30 has a base notch 16 and a hole 36 in base notch 16. Base notch 16 provides clearance for hinge link 20 and is aligned with cover notch 13. Base 30 also has a cavity 32 which typically contains a tray of cosmetic pressed powder.

Figure 3:
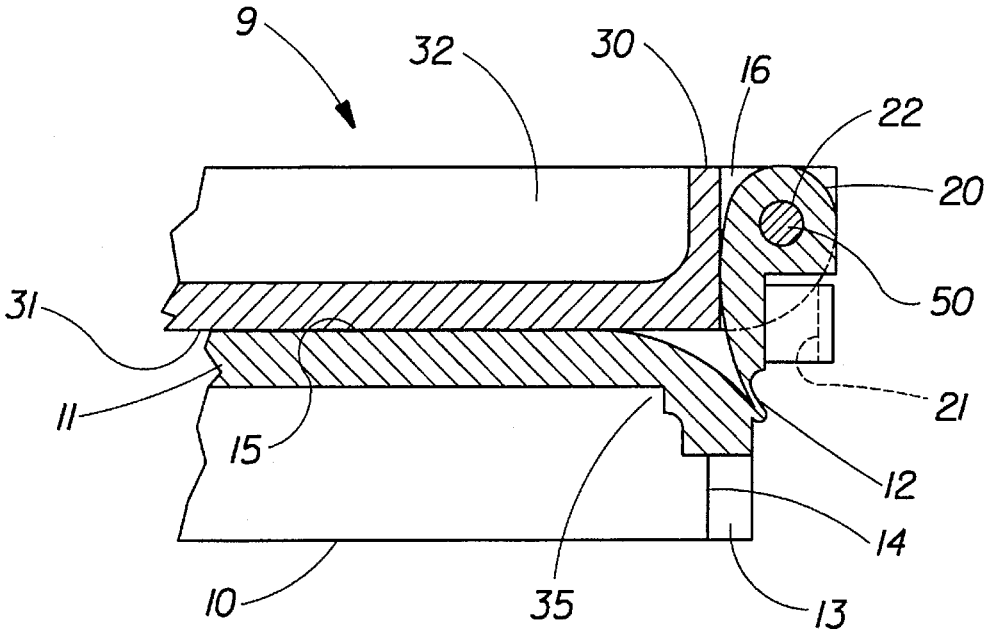
FIG. 3 is a simplified partial cross sectional view of an assembled compact case made in accordance with the present invention, taken along section line 3—3 of FIG. 1, disclosing the show shade condition with the upper surface of the cover abutting the lower surface of the base.

In FIG. 3 there is shown a partial cross-sectional view of compact case 9 of the present invention. FIG. 3 shows cover portion 10 assembled to base 30 by means a hinge pin 50 through hole 22 of hinge link 20 and into corresponding hole 36 in base 30. Cover 11 is integrally joined to hinge link 20 by means of hinge strap 12. Compact case 9 is shown in the show shade condition such that an upper surface 15 of cover 11 abuts a lower surface 31 of base 30. Cover 11 has a cavity 35 which typically contains a mirror and/or a cosmetic applicator. A transparent plastic shrink wrap may envelope exposed cavities 32 and 35 to protect and retain the pressed powder and applicator. After purchase, the user removes the shrink wrap and may then rotate cover 11 relative to base 30 about hinge strap 12.

Figure 4:
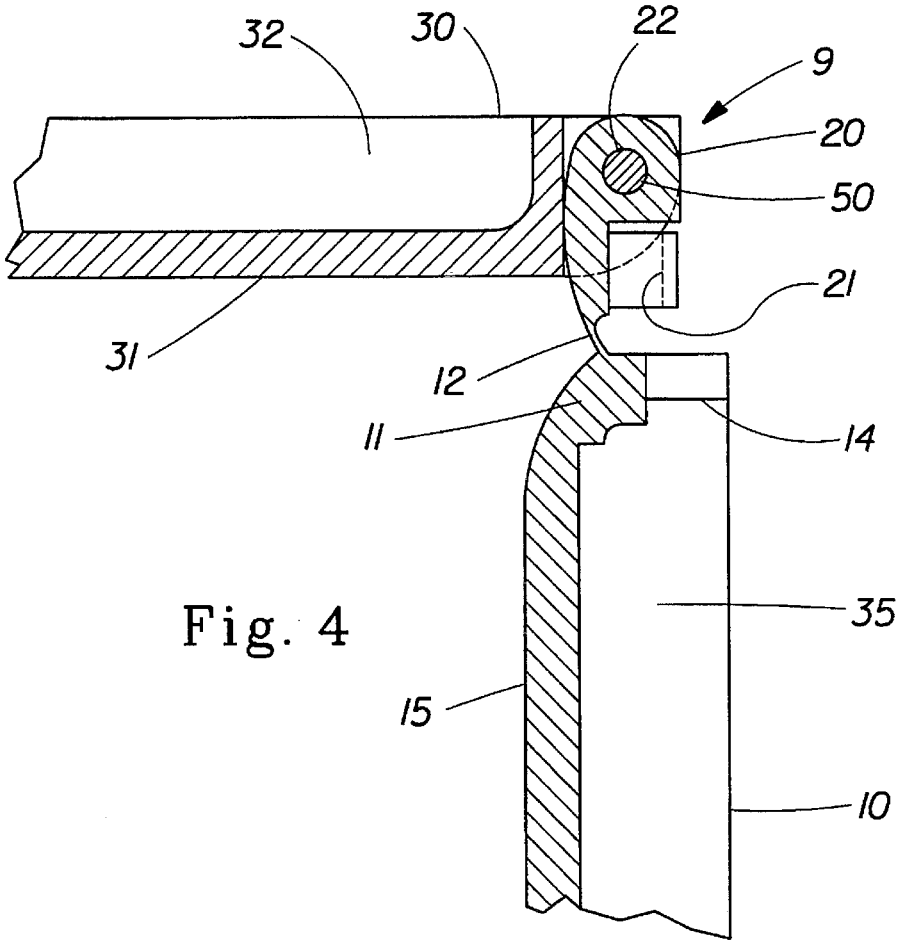
FIG. 4 is a view similar to FIG. 3, but showing the cover rotated about 90° from the initial position.
Figure 5:
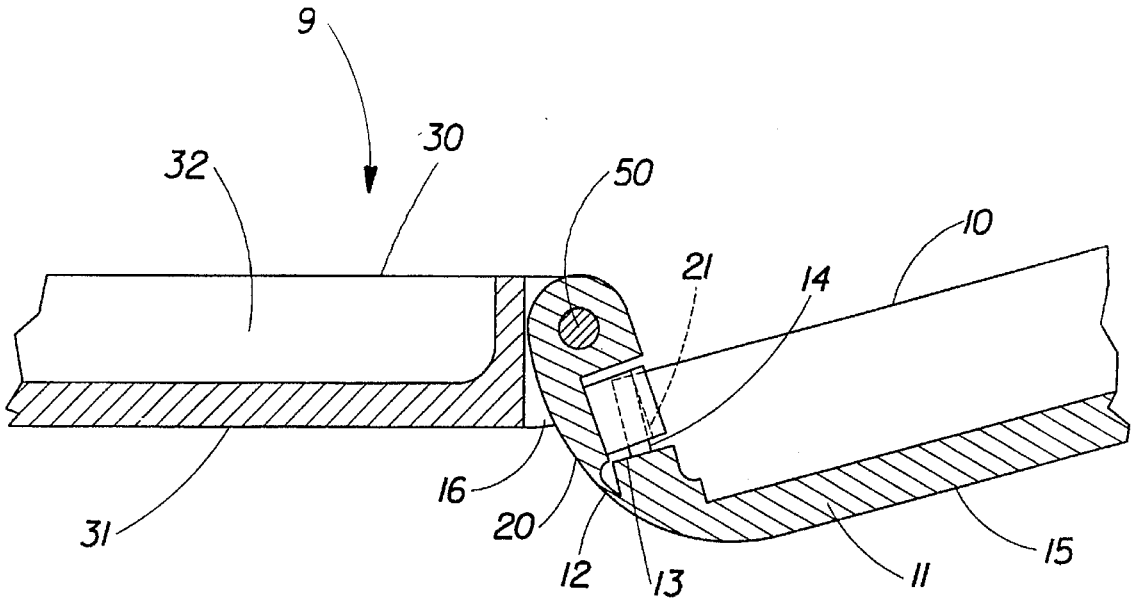
FIG. 5 is a view similar to FIG. 3, but showing initial engagement of a cover latching mechanism.

In FIG. 4 cover 11 is shown rotated 90° about hinge strap 12. Further rotation of cover 11 causes tabs 14 to begin to engage latches 21. The interference of tabs 14 and latches 21 produces resistance when a user subsequently causes hinge link 20 to rotate about binge pin 50 as shown in FIG. 5.

Figure 6:
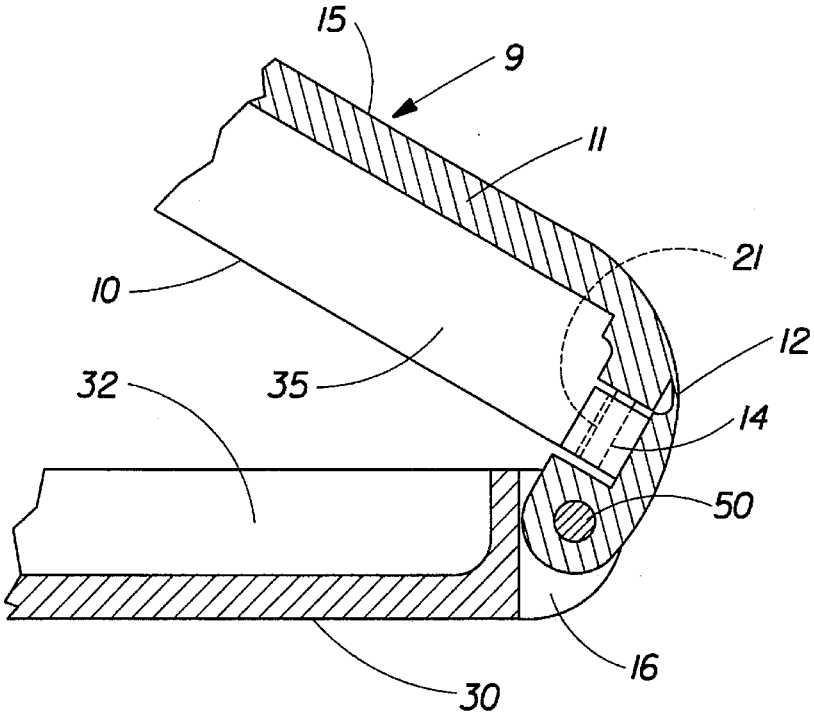
FIG. 6 is a view similar to FIG. 3, but showing full engagement of the cover latching mechanism.

In FIG. 6 barbed latches 21 fully and irreversibly engage tabs 14. Hinge strap 12 and the portion of hinge link 20 directly adjoining hinge strap 12 fit snugly into cover notch 13 thus providing a clean aesthetic appearance. The engagement of tabs 14 and latches 21 prevent subsequent rotation of cover 11 relative to hinge link 20.

Figure 7:
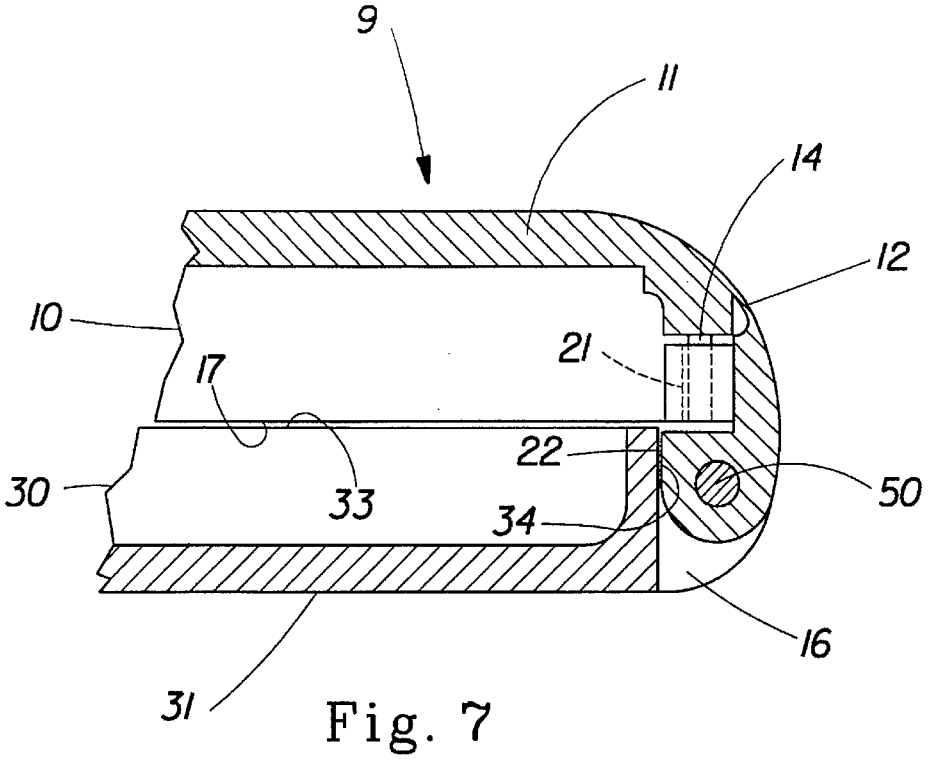
FIG. 7 is a view similar to FIG. 3, but showing the cover in the closed condition.

FIG. 7 shows compact case 9 in the closed condition, such that a perimeter surface 33 of base 30 opposes a perimeter surface 17 of cover 11. If locking of latches 21 onto tabs 14 is not fully accomplished as cover 11 approaches its closed condition, an inner wall 22 of hinge link 20 will contact an inner wall 34 of base notch 16 to limit further rotation of hinge link 20. Subsequent rotation of cover 11 must be about hinge strap 12 thereby forcing full engagement of latches 21 onto tabs 14.

Figure 8:
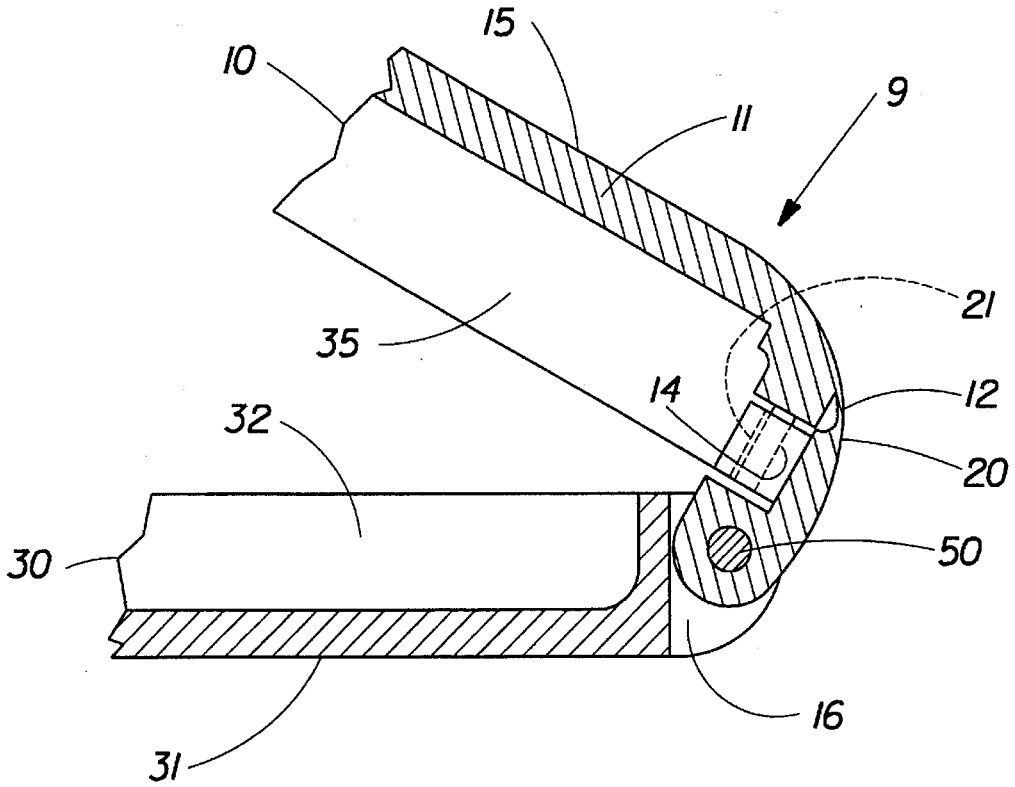
FIG. 8 is a view similar to FIG. 3, but showing the cover partially opened.

FIG. 8 shows the compact in the partially opened condition subsequent to initial closing. In this compact opening and all subsequent compact openings, cover portion 10 rotates relative to base 30 about pin 50 only. Since there is no further need for complete opening of cover 11 to the show shade condition, rotation of cover 11 relative to hinge link 20 is prevented.

Compact cases of this type may be injection molded of polymeric materials such as polypropylene (PP), acrylonitrile butadiene styrene terpolymer (ABS), or the like.

While particular embodiments of the present invention have been illustrated and described herein it will be obvious to those skilled in the art that various changes and modifications can be made without departing from the spirit and scope of the present invention and it is intended to cover in the appended claims all such modifications that are within the scope of this invention.

What is claimed is:

1. A compact case comprising:

a) a base having a base notch and a lower surface;

b) a cover portion including a cover integrally joined to a hinge link by a flexible hinge strap, said cover having a cover notch, and an upper surface;

c) a single pin rotatably attaching said hinge link of said cover portion in said base notch of said base, said compact case having an initial show shade condition wherein said upper surface of said cover abuts said lower surface of said base, and wherein said cover may be rotated 360° about said hinge pin and said hinge strap to a closed condition.

2. A compact case comprising:

a) a base having a base notch and a lower surface;

b) a cover portion including a cover integrally joined by a flexible hinge strap to a hinge link having at least one tab, said cover having a cover notch, an upper surface, and at least one latch adapted to engage said at least one tab on said hinge link to irreversibly connect said at least one tab to said at least one latch;

c) a single hinge pin rotatably attaching said hinge link of said cover portion in said base notch of said base, said compact case having an initial show shade condition wherein said upper surface of said cover abuts said lower surface of said base, and wherein said cover may be rotated 360° about said hinge pin and said hinge strap to a closed condition.

3. A compact case comprising:

a) a base having a base notch and a lower surface;

b) a cover portion including a cover integrally joined to a hinge link by a flexible hinge strap, said hinge strap being between 0.010 and 0.015" thick, said cover having a cover notch, an upper surface, and at least one latch adapted to engage at least one tab on said hinge link to irreversibly connect said at least one tab to said at least one latch;

c) a single hinge pin rotatably attaching said hinge link of said cover portion in said base notch of said base, said compact case having an initial show shade condition wherein said upper surface of said cover abuts said lower surface of said base, and wherein said cover may be rotated 360° about said hinge pin and said hinge strap to a closed condition.

* * * * *

UNITED STATES PATENT AND TRADEMARK OFFICE
CERTIFICATE OF CORRECTION

PATENT NO. : 5,568,820

DATED : October 29, 1996

INVENTOR(S) : Robert S. Dirksing

It is certified that error appears in the above-identified patent and that said Letters Patent is hereby corrected as shown below:

*Column 6, Claim 3, paragraph (b) lines 1 and 2, move the passage "by a flexible hinge strap" after "integrally joined" and add -- having at least one tab-- after "hinge link". In line 3, add the word -- said-- in front of "at least one tab".*

Signed and Sealed this

Seventh Day of December, 1999

*Attest:*

Q. TODD DICKINSON

*Attesting Officer*

*Acting Commissioner of Patents and Trademarks*